US007410084B1

(12) United States Patent
Reed

(10) Patent No.: US 7,410,084 B1
(45) Date of Patent: Aug. 12, 2008

(54) MULTIPLE-IMPACT ADAPTER FOR A HAMMER TOOL

(76) Inventor: Daniel J. Reed, 8768 State Route 123, Blanchester, OH (US) 45107

( * ) Notice: Subject to any disclaimer, the term of this patent is extended or adjusted under 35 U.S.C. 154(b) by 0 days.

(21) Appl. No.: 09/944,009

(22) Filed: Aug. 31, 2001

(51) Int. Cl.
*B25C 1/14* (2006.01)
*B25C 7/00* (2006.01)

(52) U.S. Cl. ..... 227/119; 227/150; 173/202; 173/DIG. 2

(58) Field of Classification Search ..... 227/119, 227/147, 109, 150, 15, 110, 142, 9, 10, 11; 173/202, DIG. 2
See application file for complete search history.

(56) References Cited

U.S. PATENT DOCUMENTS 30,617 A * 11/1860 Crawford ..... 47/6
1,699,519 A 1/1929 Brown
2,472,353 A 6/1949 Van Sittert et al.
2,671,216 A 3/1954 Fox
3,042,004 A 7/1962 Fischer et al.
3,219,248 A 11/1965 Krewson
3,341,101 A * 9/1967 Butler et al. ..... 227/8
3,602,419 A * 8/1971 Doberne et al. ..... 227/147
3,658,229 A * 4/1972 Pomeroy ..... 227/10
3,734,515 A * 5/1973 Dudek ..... 279/144
3,820,705 A * 6/1974 Beals ..... 227/113
4,030,654 A * 6/1977 York ..... 227/110
4,108,252 A * 8/1978 Stroezel ..... 173/176
4,139,137 A * 2/1979 Gupta ..... 227/123
4,146,071 A * 3/1979 Mueller et al. ..... 81/434
4,269,450 A * 5/1981 Welborn ..... 299/39.8
4,404,877 A * 9/1983 Mizuno et al. ..... 81/57.37
4,511,074 A * 4/1985 Kille et al. ..... 227/113
4,519,536 A * 5/1985 Steigauf ..... 227/147
4,830,254 A * 5/1989 Hsu ..... 227/10
4,834,342 A * 5/1989 Padgett ..... 227/147
5,429,291 A * 7/1995 Thompson ..... 227/10
5,495,973 A * 3/1996 Ishizawa et al. ..... 227/8
D397,125 S 8/1998 Boisvert
5,927,163 A * 7/1999 Habermehl et al. ..... 81/434
5,979,735 A * 11/1999 Olvera et al. ..... 227/119
6,123,243 A * 9/2000 Pfister et al. ..... 227/10
6,158,528 A * 12/2000 Izumisawa ..... 173/168
6,164,170 A * 12/2000 Habermehl et al. ..... 81/434
6,179,192 B1 * 1/2001 Weinger et al. ..... 227/8
6,220,495 B1 * 4/2001 Jakob ..... 227/10

* cited by examiner

*Primary Examiner*—Scott A. Smith
*Assistant Examiner*—Gloria R. Weeks

(57) ABSTRACT

The multiple-impact adapter for a hammer tool includes a shroud for removably mounting on the hammer tool. A bore is formed through the shroud between the ends. The shroud has front portion and a rear portion for removably receiving a portion of the hammer device. A drive punch is positioned in the bore for being impacted by the hammer tool and a forward end for impacting an object to be driven. A guide bushing extends forwardly from the shroud. A channel extends through the bushing for receiving a portion of the object to be driven. The guide bushing is slidably mounted on the front portion of the shroud such that the guide bushing is movable between an extended position and a retracted position.

15 Claims, 5 Drawing Sheets

MULTIPLE-IMPACT ADAPTER FOR A HAMMER TOOL

BACKGROUND OF THE INVENTION

1. Field of the Invention

The present invention relates to hammer tool adapters and more particularly pertains to a new multiple-impact adapter for a hammer tool for permitting the hammer tool to be used to drive an object through multiple impacts on the object with the object being positioned directly under the driver of the hammer tool.

2. Description of the Prior Art

The use of power tools using a single-impact to drive an object (such as, for example, a nail) has become popular as a time and effort reducing measure. Specialized tools have been developed for this purpose, but because of the single-impact action, and the need to keep the tool light enough to carry for long periods of time, these tools have generally been limited in the size of the fastener that can be driven thereby and the positioning of the object to be driven.

Specialized multiple-impact tools have been devised for driving fasteners, although some are known to be limited in driving power. Some of the specialized fastener drivers employ a palm-held design that is relatively small and light, but this diminishes the driving power of the device. Also, the typical broadness of the width of the palm-held devices make them difficult to maneuver into small spaces for driving fasteners or positioning items into structures, such as, for example, joist hangers. The reaction force of the impacts is directly applied to the palm of the hand of the user, which is considered to be undesireable for the comfort and safety of the user.

Air-powered hammer tools have been devised for multiple-impact chiseling operations, and multiple impact adapters for mounting on the hammer tools are known in the prior art. Such adapter devices tend to be relatively bulky structures in both the length of the adapter and the width of the adapter. When mounted on a nose section of a hammer tool, these known devices tend to restrict the ability of the adapter and hammer tool combination to be used in confined spaces. One reason for the overall bulkiness of the known devices is the relative large number of parts employed in such devices.

Further, known devices tend to be noisy to use due to the multiple impacts with the fastener being driven by the adapter, and this is especially a problem when the user needs to hold the hammer tool and adapter above or close to his or her head.

Still further, the structure of known devices tend to have a "one-size-fits-all" design that limits the user's ability to adapt the device to the particular object being driven, especially with respect to length of the object and the diameter of the object.

The multiple-impact adapter for a hammer tool according to the present invention substantially departs from the conventional concepts and designs of the prior art, and in so doing provides an apparatus primarily developed for the purpose of permitting the hammer tool to be used to drive a fastener or positioning item with multiple impacts.

SUMMARY OF THE INVENTION

In view of the foregoing disadvantages inherent in the known types of hammer tool adapters now present in the prior art, the present invention provides a new multiple-impact adapter for a hammer tool construction wherein the same can be utilized for permitting the hammer tool to be used to drive a fastener or positioning item with multiple impacts, as well as being used for its original design intent.

The present invention generally comprises a shroud for removably mounting on the hammer tool, and having a forward end and a rearward end, and a bore being formed through the upper shroud between the forward and rearward ends. The shroud has a rear portion located at the rearward end of the shroud for removably receiving a portion of the hammer device, and a front portion located forward of the rear portion. A drive punch is positioned in the bore of the shroud with a rear section for being impacted by the reciprocating impact member of the hammer tool and a forward end for impacting an object to be driven. A guide bushing extends forwardly from the shroud, with a forward end and a rearward end. A channel extends through the guide bushing between the forward and rearward ends for receiving a portion of the object to be driven. The guide bushing is slidably mounted on the front portion of the shroud such that the guide bushing is movable between an extended position and a retracted position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
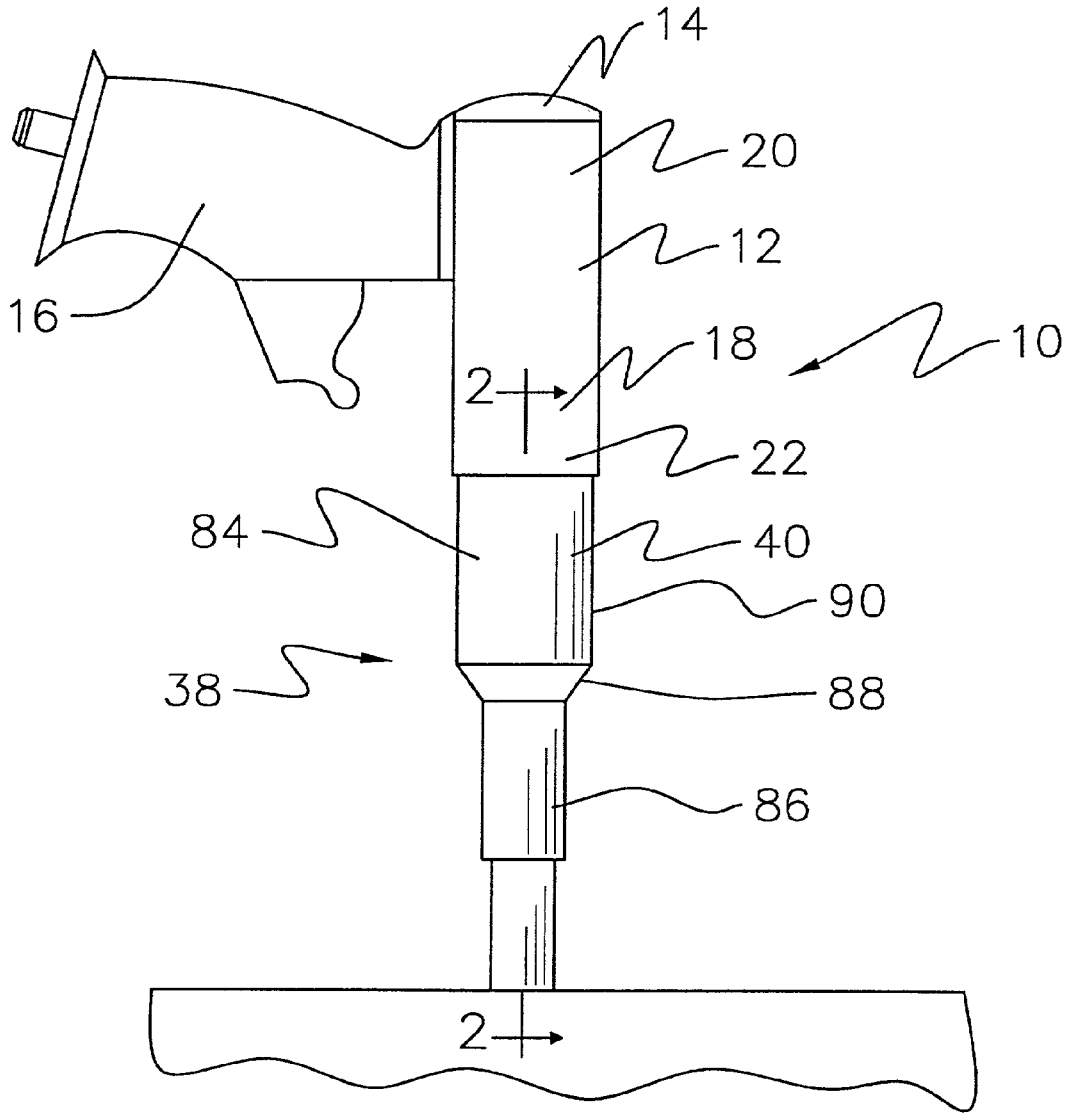
FIG. 1 is a schematic side view of a new multiple-impact adapter for a hammer tool according to the present invention mounted on a hammer tool.
Figure 2:
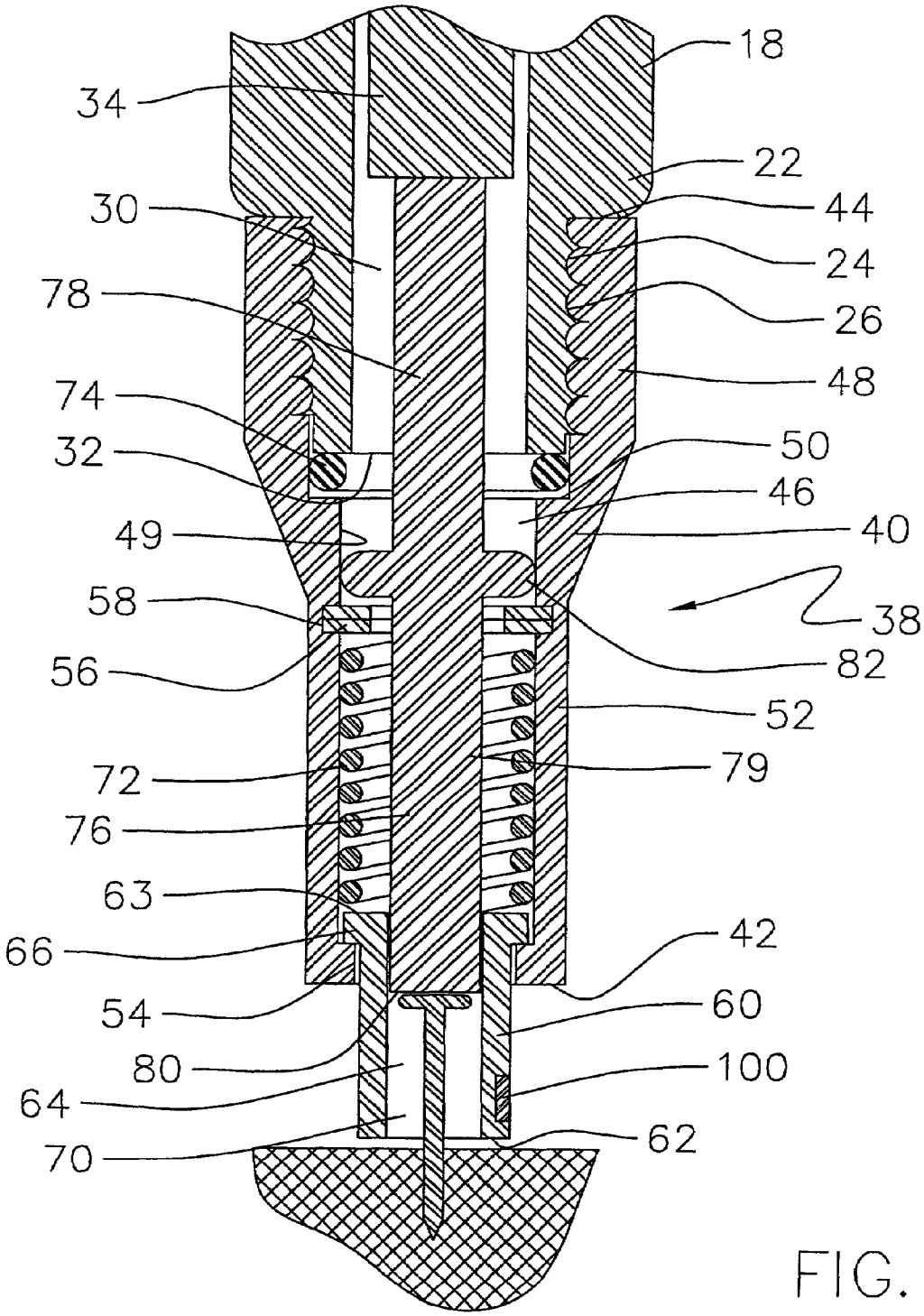
FIG. 2 is a schematic sectional view of the present invention taken along line 2—2 of FIG. 1.
Figure 3:
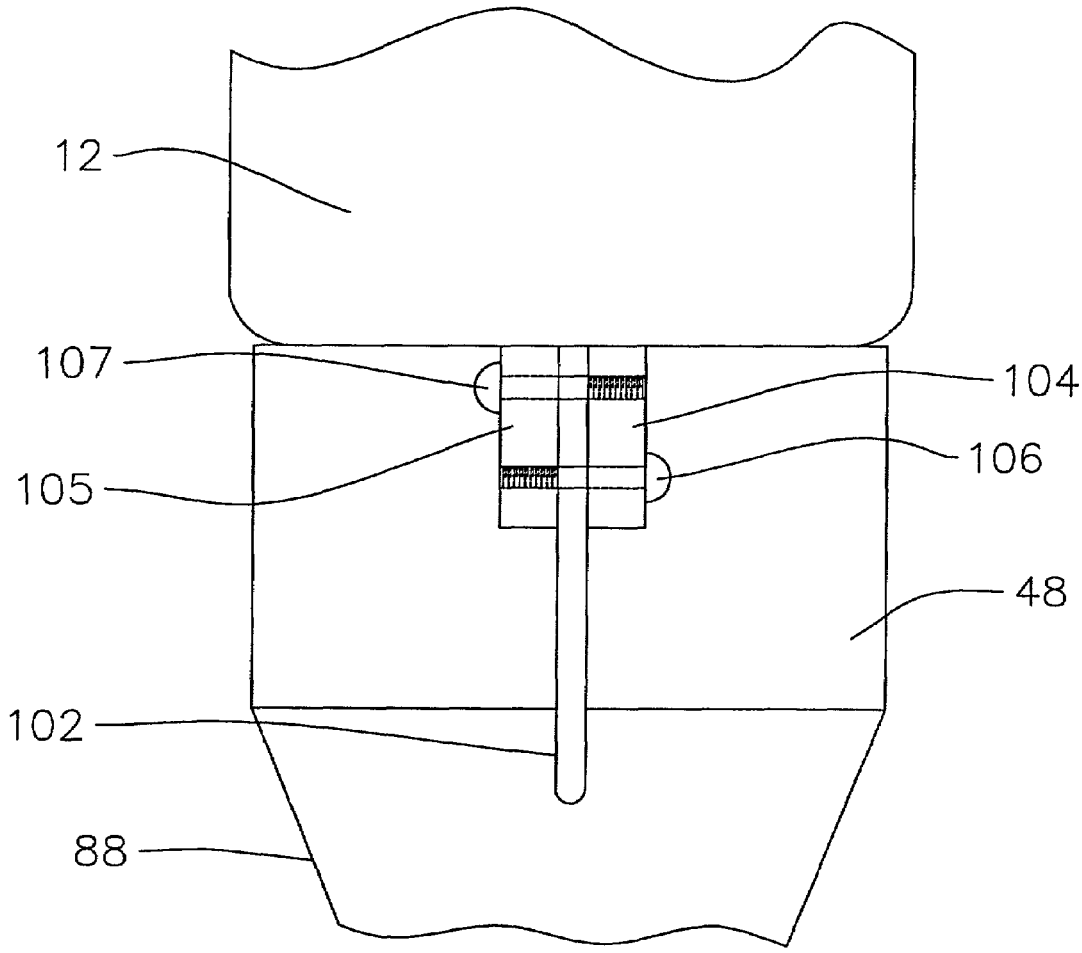
FIG. 3 is a schematic side view of a broken away portion of the present invention particularly illustrating one optional means of retaining the shroud on the hammer device.
Figure 4:
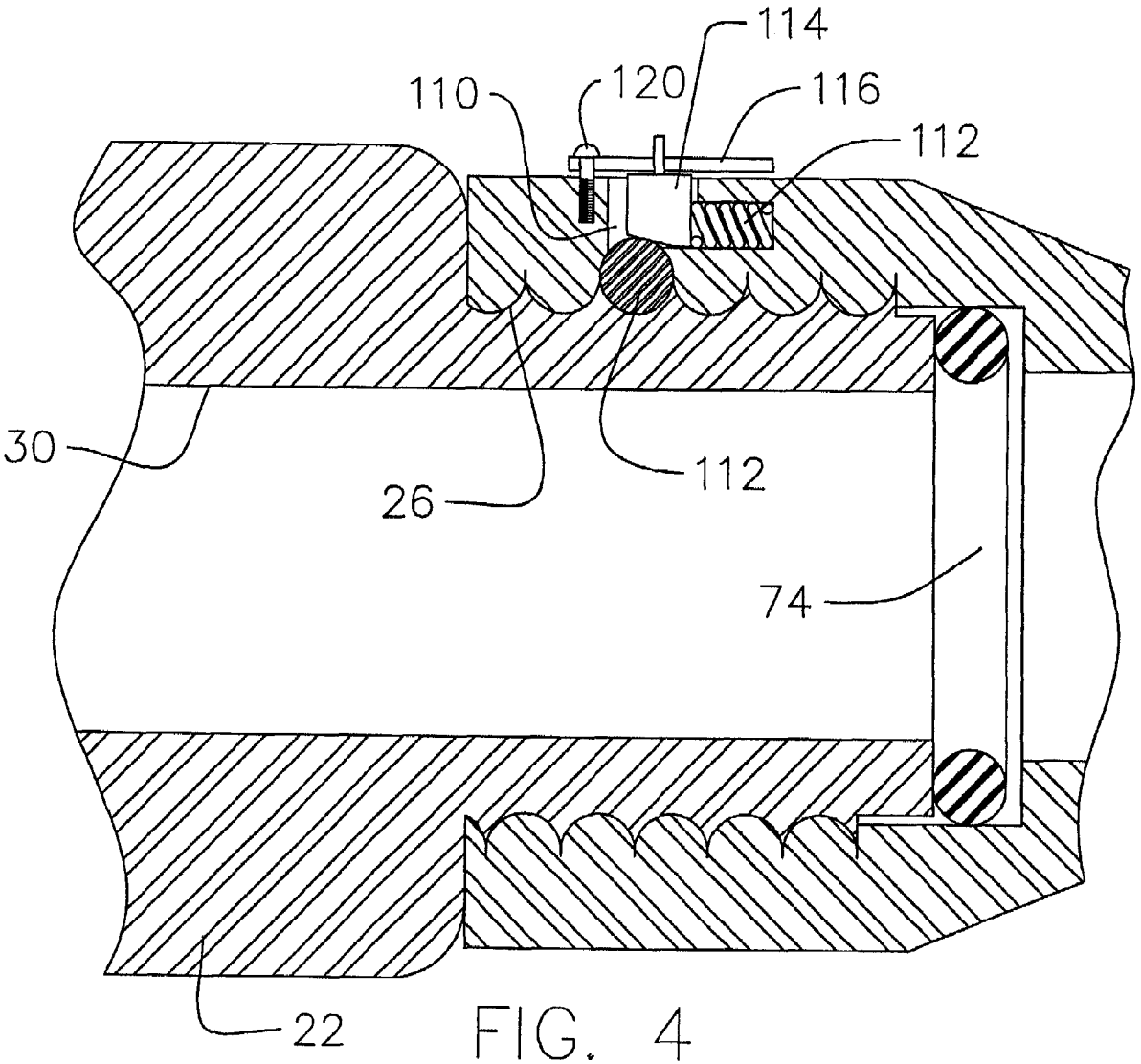
FIG. 4 is a schematic sectional view of a portion of the shroud and nose section of the hammer device particularly illustrating another optional means of retaining the shroud on the hammer device.
Figure 5:
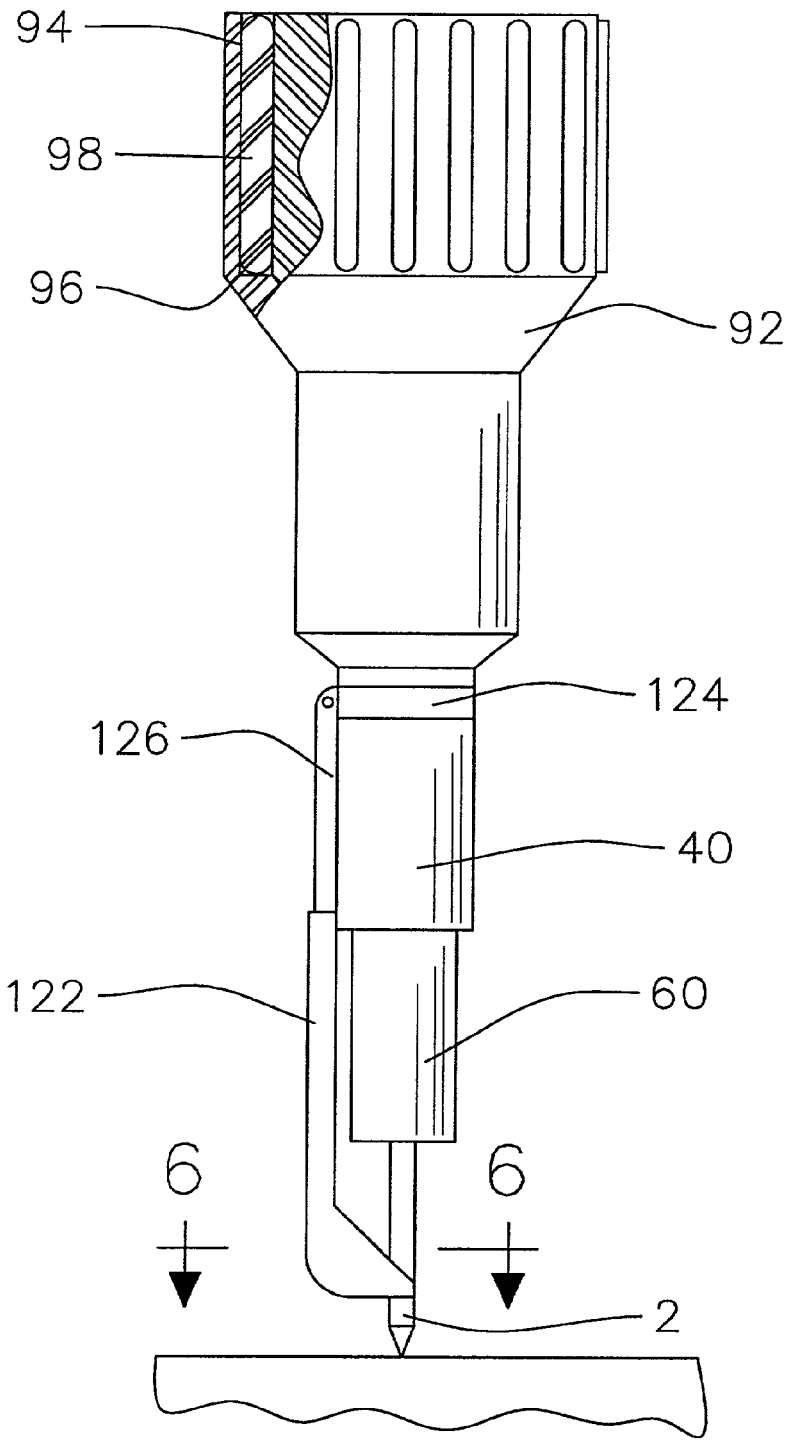
FIG. 5 is a schematic side view of an embodiment of the present invention having an optional extender assembly and muffler member.
Figure 6:
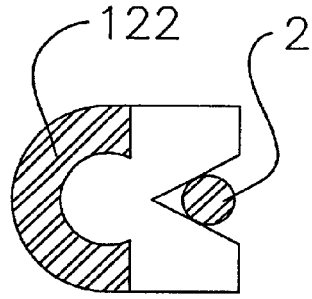
FIG. 6 is a schematic sectional view of the extender assembly taken along line 6—6 of FIG. 5.

With reference now to the drawings, and in particular to FIGS. 1 through 6 thereof, a new multiple-impact adapter for a hammer tool embodying the principles and concepts of the present invention and generally designated by the reference numeral 10 will be described.

One aspect of the invention contemplates a multiple impact object driving system 10, and includes a hammer tool 12 for impacting an object 2. The object to be driven by the invention may comprise a fastener such as a nail, roll pin, dowel pin, or even wooden dowels. The hammer tool has a housing 14 which includes a handle portion 16 and a barrel portion 18 which is mounted on the handle portion. The barrel portion of the housing has a rear section 20 and a nose section 22. Typically, an outer surface 24 of the nose section has a plurality of mounting threads 26 formed thereon for mounting various nose attachments. A passage 30 generally extends through the barrel portion of the housing, and an opening 32 in the nose section extends into the passage. A reciprocating impact member 34 is positioned in the passage toward a rear location of the passage. In one embodiment of the invention, the hammer tool comprises an air powered hammer tool that is connectable to a source of compressed air such that movement of compressed air through the hammer tool reciprocates the impact member.

Significantly, the invention includes an adapter 38 for converting the hammer tool into a multiple-impact object driving tool. The adapter includes a shroud 40 for removably mounting on the nose section of the hammer tool. The shroud has a forward end 42 and a rearward end 44. A bore 46 is formed through the upper shroud between the forward and rearward ends.

The shroud 40 has a rear portion 48 that is adapted for removably mounting on the nose section of the air hammer. The rear portion of the shroud is located at the rearward end of the shroud. An interior surface 49 of the bore at the rear portion preferably has interior threads formed thereon for threadedly engaging exterior threads on the nose of the hammer tool. The threads formed on the interior surface may be adapted for engaging various thread types, which are generally standardized. An annular interior shoulder 50 may be formed in the bore of the rear portion of the shroud.

The shroud has a front portion 52 located forward of the rear portion and at the forward end of the shroud. A lip 54 may be formed on the shroud and extends inwardly into the bore. The lip is located adjacent to the forward end of the front portion of the shroud.

A securing ring 56 may be removably mounted in the bore. The securing ring may be positioned in the bore substantially adjacent to a juncture of the front 52 and rear 48 portions of the shroud. An annular groove 58 may be formed in an interior surface of the bore for removably receiving the securing ring in a manner preventing longitudinal movement of the securing ring in the bore. The securing ring may have an interior perimeter relatively smaller than a diameter of the bore in the shroud, which can prevent over extension of the drive punch into the guide bushing by blocking movement therethrough of the punch flange therethrough. Preferably, the securing ring may take the form of a snap-ring having a break therein that permits selective constricting of the size of the ring to permit selective removal of the ring from the interior of the shroud.

A guide bushing 60 may be provided for holding the object to be driven during the multiple impacts. The guide bushing extends forwardly from the shroud. The guide bushing has a forward end 62 and a rearward end 63, and a channel 64 extends through the guide bushing between the forward and rearward ends. Preferably, an annular flange 66 is formed on the guide bushing for retaining the guide bushing on the shroud. The annular flange is located on the rearward end of the guide bushing. The annular flange extends radially outward from the guide bushing, and engages the lip extending radially inward of the front portion of the shroud for holding the guide on the shroud.

Significantly, the guide bushing is preferably slidably mounted on the front portion of the shroud for permitting the guide bushing to move with respect to the shroud. The guide bushing is movable between a retracted position and an extended position, so that the position of the guide bushing may adapt to and correspond with the protrusion of a fastener to be driven from a surface. The interior 70 of the guide bushing receives the object to be driven, and thus may hold the object in position with respect to the adapter while the object is being driven. This feature can help prevent undesirable lateral movement of the object during driving of the object. Also, the movable guide bushing minimizes the impact on a surface into which the object is being driven.

Because the guide bushing is easily removable and replaceable in the shroud by the removal of the securing ring, guide bushings of various diameter sizes may be mounted on the shroud for tailoring the diameter of the guide bushing to the particular object, or fastener, being driven. This aids in the preciseness of the guidance that can be provided by the guide bushing. The movable guide bushing may have an exposed length that is less than approximately one-third the length of the shroud, and may be as little as approximately one-fifth the length of the shroud, which increases the relative durability of the guide bushing, and makes the guide bushing strong enough to bend a fastener protruding from a surface and extending into the channel of the guide bushing. The minimization of the size of the guide bushing with respect to the size of the adapter can reduce the amount of vibration produced by the adapter, and thus can reduce the noise produced by the adapter.

Further, an outer surface of the guide bushing has a diameter that is approximately equal to or less than a diameter of the interior surface of the rear portion of the shroud.

A biasing means may be provided for biasing the guide bushing into an extended position with respect to the shroud. The biasing means illustratively comprises a compression spring 72 positioned in the bore, and being located between the securing ring and the guide bushing for pushing the guide bushing away from the securing ring and into the extended position of the guide.

A ring member 74 may be positioned in the bore adjacent to the annular interior shoulder of the rear portion for abutting the nose of the hammer tool. The ring member may be formed of a resiliently compressible material, such as, for example, a synthetic rubber material or a plastic. The compressible nature of the ring member permits a tight and secure fit between the nose section of the hammer device and the shroud, and resists vibrating the shroud loose from the hammer device.

A drive punch 76 is positioned in the bore of the shroud for transferring impacts of the reciprocating impact member to the object being driven by the adapter. The drive punch may have a rear section 78 for being impacted by the reciprocating impact member of the hammer tool, and a front section 79 with a forward end 80 for impacting an object to be driven. The forward end may extend substantially adjacent to the forward end of the shroud, and may extend a short distance into the guide bushing when the guide bushing is in a substantially fully extended condition such that when the guide bushing is fully retracted, the forward end of the drive punch extends beyond the guide bushing. An annular punch flange 82 may extend radially outwardly from the drive punch. The punch flange may be positioned generally between the front and rear sections of the drive punch. The punch flange may be positioned adjacent to the securing ring.

The shroud has an outer surface 84, and illustratively the outer surface of the shroud has a substantially cylindrical front part 86, a substantially frusta-conical intermediate part 88, and a substantially cylindrical rear part 90. A diameter of the rear part of the outer surface may be relatively larger than a diameter of the front part of the outer surface.

Optionally, a muffling means may be provided for muffling noise and vibration produced by the impacts with the object. An illustrative embodiment of the muffling means comprises a muffler member 92 mounted on the rear portion of the shroud, and extending generally rearwardly from the shroud. The muffler member has a bore 94 in communication with the bore of the shroud. An annular space 96 is preferably formed about the bore of the muffler member, and a muffling material 98 is positioned in the annular space for absorbing vibration from the impacts.

As a further option, a magnetic member 100 may be mounted on the guide bushing for facilitating holding of an object to be driven in the bushing, such as an object formed of a magnetically receptive material. The magnetic member may be located toward a front end of the guide bushing such that the magnetic member is positioned adjacent to an object to be driven at most positions of the guide bushing.

A still further option is retaining means provided for retaining the shroud on the nose of the hammer tool. The retaining means is located on the rear portion of the shroud. In one embodiment of the invention, the retaining means includes a longitudinal slit 102 formed in the rear portion of the shroud and extending from the rearward end of the shroud toward the forward end. A pair of retaining tabs 104, 105 is provided on the shroud, with each of the retaining tabs being mounted on the rear portion on a side of the longitudinal slit such that the retaining tabs are located on opposite sides of the longitudinal slit. A fastener 106 may be provided for constricting the longitudinal slit. The fastener extends through each of the retaining tabs for pulling the retaining tabs together and constricting the slit. The fastener extends in holes in each of the retaining tabs. At least one of the holes may be threaded for engaging threads on the fastener. In a preferred embodiment of the invention, a pair of fasteners 106, 107 may be mounted on the retaining tabs.

In another embodiment of the invention, the retaining means includes a recess formed in the rear portion of the shroud. The recess 110 extends between the bore of the shroud and an exterior of the shroud. A locking ball 112 is positioned in the recess, and is movable in the recess between a locked position in which the locking ball extends into the bore for engaging an exterior of the nose section of the hammer tool, and an unlocked position in which the locking ball is substantially completely retracted into the recess. A lever 114 may be movably positioned in the recess. The lever has a locked position in which the lever presses the locking ball into the locked position, and an unlocked position in which the lever permits the locking ball to retract into the recess. A spring 116 may bias the lever into the locked position. The spring may be positioned between the locking ball and a surface of the recess. A cap block 18 may be mounted over the recess for holding the lever in the recess. A fastener 120 for holding the cap block may be mounted on the shroud over the recess.

Yet another option for the invention is an extender assembly 122 that is removably mountable on the front portion of the shroud by a collar 124 that extends about the shroud. An extender member 126 is pivotally mounted on the collar, and the member 126 extends forwardly past the forward end of the shroud and past the forward end of the guide bushing. Preferably the extender member has two telescopic portions that permit adjustment of the amount of forward extension of the foremost end of the extender member. The foremost end of the extender member has a forked configuration for receiving a portion of a fastener and helping to position the fastener as it extends into the channel of the guide bushing.

The structure of the invention permits a relatively thin diameter profile for reaching into confined places where fasteners or other objects need to be driven, and also permits a relatively short and compact adapter length for further facilitating positioning of the adapter and hammer device in relatively confined spaces.

Further, removability of the securing ring permits the removal and refitting of the interior parts of the device, especially the guide bushing, which permit the use of various diameter sizes and lengths of the guide bushings to adapt to the particular object or fastener size, and even replace the compression spring with a compression spring of different characteristics.

It has been determined that the invention is highly suitable for driving objects such as fasteners, dowel pins (such as formed of metal for assembling machines and tools), wood dowel pins (such as for assembling furniture), split roll pins (such as for connecting machine parts together), and even small fence posts for supporting electric fence wires and grounding rods for attaching grounding circuits for equipment.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adapter for converting a hammer tool into a multiple-impact object driving tool, the hammer tool having a housing with a barrel portion including a rear section and a nose section, a passage extending through the barrel portion with an opening in the nose section extending into the passage, the hammer tool having a reciprocating impact member being positioned in the passage, the adapter comprising:

a shroud for removably mounting on a hammer tool, the shroud having a forward end and a rearward end, a bore being formed through the upper shroud between the forward and rearward ends, the shroud having a rear portion located at the rearward end of the shroud for removably receiving a portion of the hammer device, the shroud having a front portion located forward of the rear portion;

a drive punch positioned in the bore of the shroud with a rear section for being impacted by the reciprocating impact member of the hammer tool and a forward end for impacting an object to be driven;

a guide bushing extending forwardly from the shroud, the guide bushing having a forward end and a rearward end, a channel extending through the guide bushing between the forward and rearward ends for receiving a portion of the object to be driven, the guide bushing being slidably mounted on the front portion of the shroud such that the guide bushing is movable between an extended position and a retracted position;

wherein the channel of the guide bushing has an entire length extending from a first end of the guide bushing to a second, opposite end of the guide bushing, the channel having a uniform diameter along said entire length of the guide bushing; and wherein the uniform diameter of the channel of the guide bushing along said entire length is slightly larger than a diameter of the forward end of the drive punch;

a magnetic member mounted on the guide bushing for facilitating hold of an object to be driven in the guide bushing;

an annular groove formed in an interior surface of the bore of the shroud, and a securing ring removably mounted in annular groove in the bore for holding the securing ring in a stationary position on the shroud.

2. The adapter of claim 1 additionally comprising a biasing means for biasing the guide bushing into an extended position with respect to the shroud.

3. The adapter of claim 1 wherein the shroud has an outer surface, the outer surface of the shroud having a substantially cylindrical front part, a substantially frusta-conical intermediate part, and a substantially cylindrical rear part, a diameter of the rear part of the outer surface being relatively larger than a diameter of the front part of the outer surface.

4. The adapter of claim 1 wherein an interior surface of the bore at the rear portion has interior threads formed thereon for threadedly engaging a helical groove on an exterior of a nose of the barrel portion of the hammer tool provided for accepting a retainer spring, and wherein peaks of the interior threads are semicircular in cross-section for engaging the helical groove on the hammer tool.

5. The adapter of claim 1 wherein the shroud and the slidable guide bushing have an overall length, a length of the slidable guide bushing comprising approximately one-third of the overall length of the shroud and guide bushing.

6. The adapter of claim 1 wherein the forward end of the drive punch terminates at a forwardmost end of the front portion of the shroud.

7. The adapter of claim 1 wherein the forward end of the drive punch extends into the channel of the guide bushing when the slidable guide bushing is fully extended from the shroud.

8. The adapter of claim 1 wherein the substantially uniform diameter of the channel of the guide bushing extends along an entirety of the length of the channel of the guide bushing.

9. The adapter of claim 1 additionally comprising a magnetic member mounted on the guide bushing for facilitating bold of an object to be driven in the guide bushing.

10. An adapter for converting a hammer tool into a multiple-impact object driving tool, the hammer tool having a housing with a barrel portion including a rear section and a nose section, a passage extending through the barrel portion with an opening in the nose section extending into the passage, the hammer tool having a reciprocating impact member being positioned in the passage, the adapter comprising:

a shroud for removably mounting on a hammer tool, the shroud having a forward end and a rearward end, a bore being formed through the upper shroud between the forward and rearward ends, the shroud having a rear portion located at the rearward end of the shroud for removably receiving a portion of the hammer device, the shroud having a front portion located forward of the rear portion;

a drive punch positioned in the bore of the shroud with a rear section for being impacted by the reciprocating impact member of the hammer tool and a forward end for impacting an object to be driven;

a guide bushing extending forwardly from the shroud, the guide bushing having a forward end and a rearward end, a channel extending through the guide bushing between the forward and rearward ends for receiving a portion of the object to be driven, the guide bushing being slidably mounted on the front portion of the shroud such that the guide bushing is movable between an extended position and a retracted position; and a muffling means for muffling noise and vibration mounted on the shroud for mounting on the hammer tool with the shroud and removal from the hammer tool with the shroud;

wherein the muffling means comprises a muffler member mounted on the rear portion of the shroud, the muffler member having a bore in communication with the bore of the shroud, an annular space being formed about the bore of the muffler member for extending about a barrel portion of the hammer tool when the shroud is mounted on the hammer tool, and a muffling material for absorbing vibration being positioned in the annular space for extending about the barrel portion when the shroud is mounted on the hammer tool.

11. An adapter for converting a hammer tool into a multiple-impact object driving tool, the hammer tool having a housing with a barrel portion including a rear section and a nose section, a passage extending through the barrel portion with an opening in the nose section extending into the passage, the hammer tool having a reciprocating impact member being positioned in the passage, the adapter comprising:

a shroud for removably mounting on a hammer tool, the shroud having a forward end and a rearward end, a bore being formed through the upper shroud between the forward and rearward ends, the shroud having a rear portion located at the rearward end of the shroud for removably receiving a portion of the hammer device, the shroud having a front portion located forward of the rear portion;

a drive punch positioned in the bore of the shroud with a rear section for being impacted by the reciprocating impact member of the hammer tool and a forward end for impacting an object to be driven;

a guide bushing extending forwardly from the shroud, the guide bushing having a forward end and a rearward end, a channel extending through the guide bushing between the forward and rearward ends for receiving a portion of the object to be driven, the guide bushing being slidably mounted on the front portion of the shroud such that the guide bushing is movable between an extended position and a retracted position;

wherein the channel of the guide bushing has an entire length extending from a first end of the guide bushing to a second, opposite end of the guide bushing, the channel having a substantially uniform diameter along said entire length of the guide bushing;

wherein the rear portion of the shroud includes retaining means for retaining the shroud on the nose of the hammer tool; wherein the retaining means includes:

a longitudinal slit formed in the rear portion of the shroud toward the forward end; and a pair of retaining tabs, each of the retaining tabs are located on opposite sides of the longitudinal slit; and a fastener for constricting the longitudinal slit by pulling the retaining tabs toward each other.

12. The adapter of claim 11 wherein the retaining means includes:

a recess formed in the rear portion of the shroud, the recess extending between the bore of the shroud and an exterior of the shroud;

a locking ball positioned in the recess and being movable in the recess between a locked position in which the locking ball extends into the bore for engaging an exterior of a nose section of the hammer tool, and an unlocked position in which the locking ball is substantially completely retracted into the recess;

a lever movably positioned in the recess, the lever having a locked position in which the lever presses the locking ball into the locked position and an unlocked position in which the lever permits the locking ball to retract into the recess.

13. An adapter for converting a hammer tool into a multiple-impact object driving tool, the hammer tool having a housing with a barrel portion including a rear section and a nose section, a passage extending through the barrel portion with an opening in the nose section extending into the passage, the hammer tool having a reciprocating impact member being positioned in the passage, the adapter comprising:

a shroud for removably mounting on a hammer tool, the shroud having a forward end and a rearward end, a bore being formed through the upper shroud between the forward and rearward ends, the shroud having a rear portion located at the rearward end of the shroud for removably receiving a portion of the hammer device, the shroud having a front portion located forward of the rear portion;

a drive punch positioned in the bore of the shroud with a rear section for being impacted by the reciprocating impact member of the hammer tool and a forward end for impacting an object to be driven;

a guide bushing extending forwardly from the shroud, the guide bushing having a forward end and a rearward end, a channel extending through the guide bushing between the forward and rearward ends for receiving a portion of the object to be driven, the guide bushing being slidably mounted on the front portion of the shroud such that the guide bushing is movable between an extended position and a retracted position; and an extender assembly removably mounted on the shroud, the extender assembly including a collar extending about the shroud and an extender member pivotally mounted on the collar and extending forwardly past the forward end of the shroud and the forward end of the guide bushing, a foremost end of the extender member having a forked configuration for receiving a portion of a fastener to position the fastener as it extends into the channel of the guide bushing.

14. The adapter of claim 13 wherein the extender member comprises has two telescopic portions permitting adjustment of the amount of forward extension of the foremost end of the extender member.

15. The adapter of claim 13 wherein the forked configuration of the foremost end of the extender member includes a pair of converging edges in a concave configuration.

* * * * *